United States Patent [19]

Bell

[11] Patent Number: 4,561,578

[45] Date of Patent: Dec. 31, 1985

[54] BACKPACK FOR HIKERS

[76] Inventor: Michael S. Bell, 354 Daytona, Goleta, Calif. 93117

[21] Appl. No.: 661,664

[22] Filed: Oct. 17, 1984

[51] Int. Cl.[4] ..... A45F 3/10

[52] U.S. Cl. ..... 224/262; 224/153; 224/215; 224/264

[58] Field of Search ..... 224/262, 213, 153, 215, 224/261, 260

[56] References Cited

U.S. PATENT DOCUMENTS

| | | | |
|---|---|---|---|
| 3,282,483 | 11/1966 | Babcock | 224/262 |
| 3,563,431 | 2/1971 | Pletz | 224/262 |
| 3,885,722 | 5/1975 | Robertson | 224/261 |
| 3,889,109 | 8/1975 | Noice | 224/262 |
| 4,217,998 | 8/1980 | Alexander | 224/261 |

*Primary Examiner*—Stephen Marcus
*Assistant Examiner*—Robert Petrik
*Attorney, Agent, or Firm*—Donald D. Mon

[57] ABSTRACT

A backpack with a frame to carry a load. The frame has a pair of upright rails, one at each side of the hiker. An encircling belt is attached to each of the upright rails, and a pair of shoulder rests fit over each of the shoulders. Front and rear risers connect to the front and rear legs of the shoulder rests. The rear risers rise from the back of the belt, and the front risers connect to the upright rails. Balance rods extend forwardly from the frame and are vertically pivotable. They can lift and lower the shoulder rests. Forward load-attachment devices on the balance rods can carry a forwardly mounted load.

17 Claims, 5 Drawing Figures

10
11
16
19
55
50
70
40
37
90
23
43
90
39
20
90
25
35
45
90
33
30
31
26
21

FIG. 3
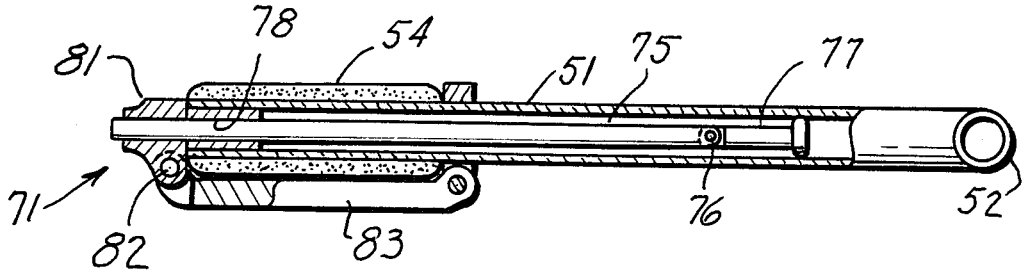
FIG. 4
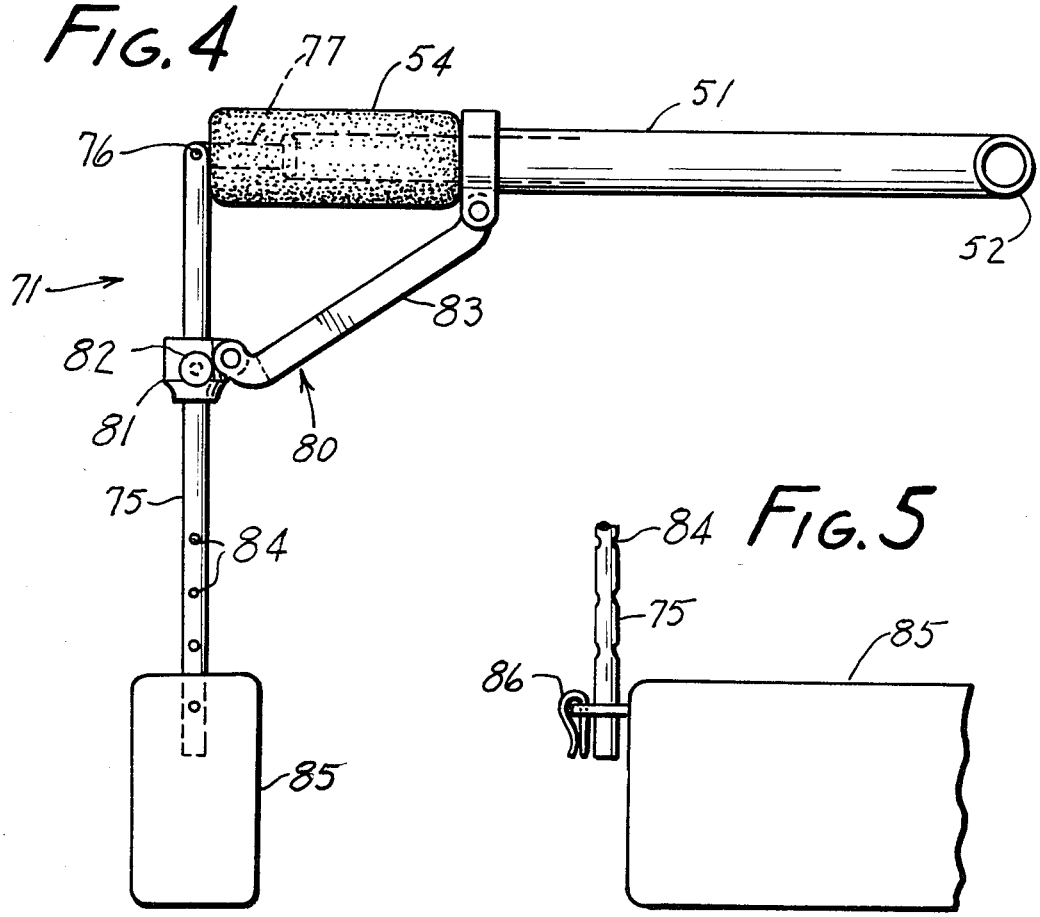
FIG. 5

BACKPACK FOR HIKERS

FIELD OF THE INVENTION

This invention relates to a backpack which provides optional or simultaneous weight bearing by the torso or by the shoulders, and the optional carrying of a forward counterbalancing load, all relates to a frame.

BACKGROUND OF THE INVENTION

Conventional backpacks include a frame which is carried by the hiker by means of straps which pass over his shoulders, and an encircling belt. The unit is fitted to the hiker by selection of the places where the straps are attached to the frame and adjusting their length, and by selecting the places where the belt is attached to the frame, the selected locations meaning the place of attachment along an upright dimension. This gives the unit some adaptability to the individual hiker, but it is in the sense of a one-time fit.

To the serious backpacker, the reduction of fatigue is a matter of prime importance. Reducing fatigue in effect lengthens his day because he can accomplish more in addition to the basic chore of carrying his equipment along with him. This invention, while of utility to any backpacker, is principally directed toward the serious, high performance backpacker whose efforts will generally be exerted at or near his personal maximum.

While the single fit described above for conventional backpacks can, of course, be adjusted from time to time, this is a time-consuming and therefore an undesirable thing. It is an object of this invention to provide to the backpacker a device which can be adjusted on a "running", on-going basis, to vary the share of the load carried by the torso and shoulders, to carry forwardly-mounted counterbalancing loads whose effective moment can also be adjusted on an on-going basis, and to provide hand-holds which are convenient to the hiker that enable him further to adjust the balance of the load on a temporary basis.

BRIEF DESCRIPTION OF THE INVENTION

A backpack according to this invention includes a frame which has a pair of spaced-apart, generally upright rails, and a pair of vertically spaced-apart laterally-extending cross rails joining the upright rails. Each of the upright rails has a lower portion disposed at the side of the hiker, one on each side of him.

A waist-encircling belt is attached to each of the lower portions. It includes a separable buckle so the belt can be held in an encircling position, or can be released.

Two rear risers are attached to the belt at spaced-apart locations on the rear of the belt. Two shoulder rests are adapted to fit, one on each shoulder of the hiker. Each shoulder rest has a front leg and a rear leg. The rear legs are each attached to a respective rear riser. Two front risers are provided. One is attached to each of the lower portions of the upright rails, and to a respective front riser. Thus, there are two load-bearing loops—one over each shoulder, running from the belt to the upright rails. The shoulder rests are formed stiffly enough that they will not "pull over" the shoulder.

A pair of balance rods are pivotally mounted to the frame, one rod extending over each shoulder. Connection means connects each shoulder rest to a respective balance rod. These enable this connection to be made at a plurality of locations along the balance rods. Suspender means interconnects an upper region of the frame with each of the balance rods. The balance rods can be pivotally moved up and down so as to change the relative height of the shoulder rests, and the suspender means determine the lowermost pivotal position. They are adjustable.

Forward load-attachment means is mounted to each of the balance rods, forwardly of the frame, for supporting a load forwardly of the hiker. A hand grip can also be provided on each of the balance rods.

With the foregoing arrangement, the load can be carried entirely by the belt, by adjusting the suspender means so that the balance rods lift the shoulder rests off the shoulders. The load can be carried entirely by the shoulder rests by unbuckling the belt, and adjusting the shoulder rests so they comfortably fit on the shoulders. The load may be divided between the torso and the shoulders by fastening the belt, and lowering the shoulder rests onto the shoulders. The hiker may partially determine the ratio by pulling down on the grips on the balance rods as he walks.

Forward-rearward balance can be adjusted by adjustment of the connection means along the balance rods. Assuming an upright hiker, this adjustment moves the load forwardly or rearwardly relative to his shoulders. A load suspended forwardly from the balance rods will further counterbalance the load.

The above and other features of this invention will be fully understood from the following detailed description and the accompanying drawings, in which:

BRIEF DESCRIPTION OF THE DRAWINGS

FIG. 3 is a fragmentary axial cross-section of a balance rod used in FIG. 1 in its stored condition;

FIG. 4 is a side elevation of the balance rod in its load-carrying condition; and FIG. 5 is a fragmentary front view taken in FIG. 4.

DETAILED DESCRIPTION OF THE INVENTION

The ultimate function of backpack 10 is to carry a principal load 11. As will later be shown an additional load can also be carried if desired. By way of orientation, the hiker (not shown) faces to the left in FIG. 1, with load 11 carried behind him.

Figure 2:
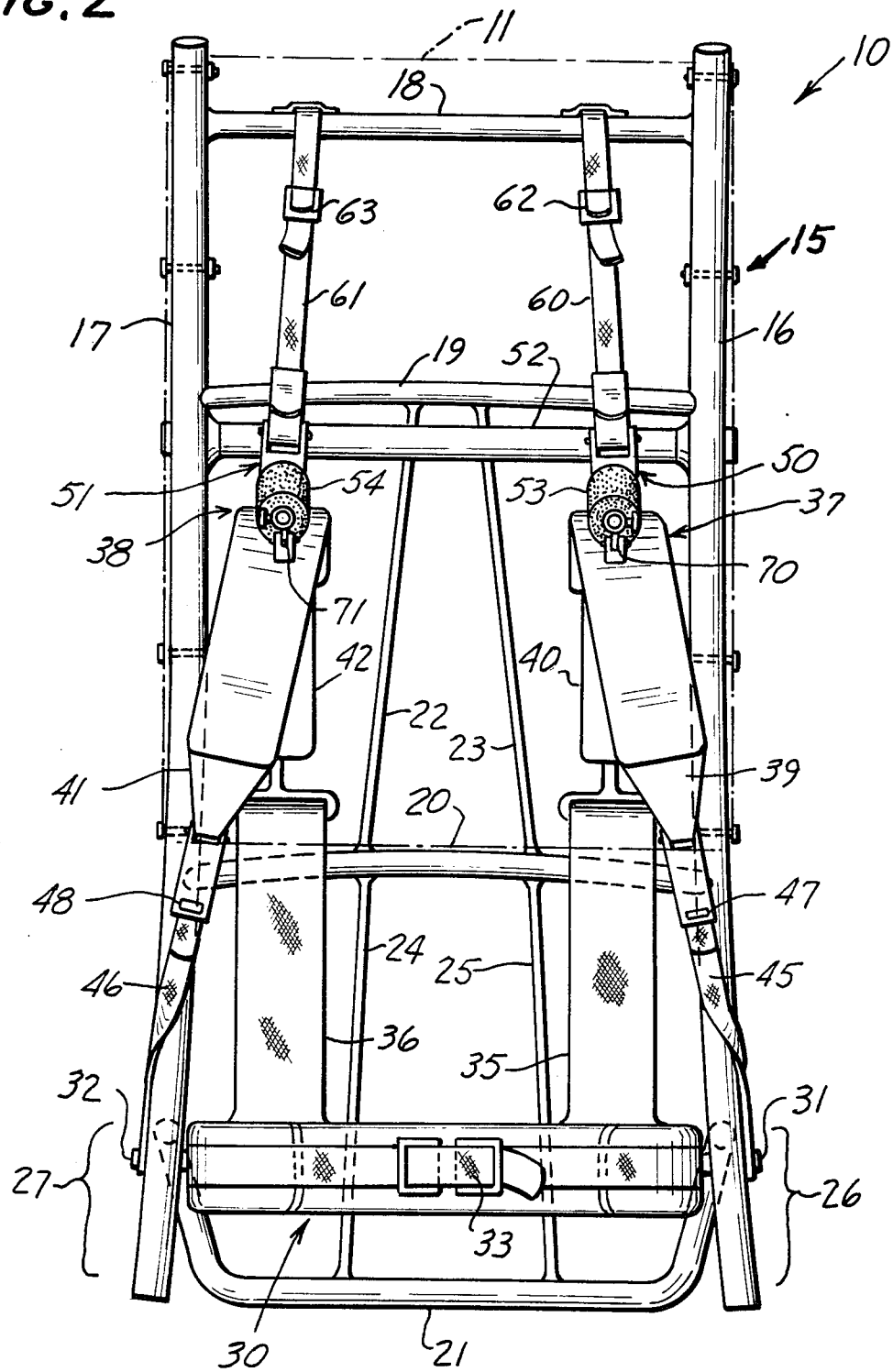
FIG. 2 is a front elevation of the device.

The backpack includes a frame 15, best shown in FIG. 2. A first rail 16 and a second rail 17 are generally upright. They are joined by vertically spaced-apart cross-rails 18, 19, 20, and 21 which are welded or otherwise attached to the upright rails to form a rigid structure. Only two of these are needed for structural integrity, but three or four are preferred to give desirable redundancy. Stiffeners 22, 23, 24 and 25 are attached variously to rails 19, 20 and 21 to give them additional support, because rails 20 and 21 are U-shaped to give clearance for the back and hips of the hiker.

Upright rails 16 and 17 have respective lower portions 26, 27, which extend forwardly to the respective side of the hiker's torso. This "lower portion" is defined as being at least as low as the belt level of the hiker.

A waist-encircling belt 30 is connected by bolts 31, 32 or other attachment means, to both of lower portion 26 and 27. It is padded, and includes a separable and adjustable buckle 33 so the belt can be fastened around the torso, or be released from it. Bolts 31 and 32 preferably enable the plane of the belt to tilt relative to the frame.

Figure 1:
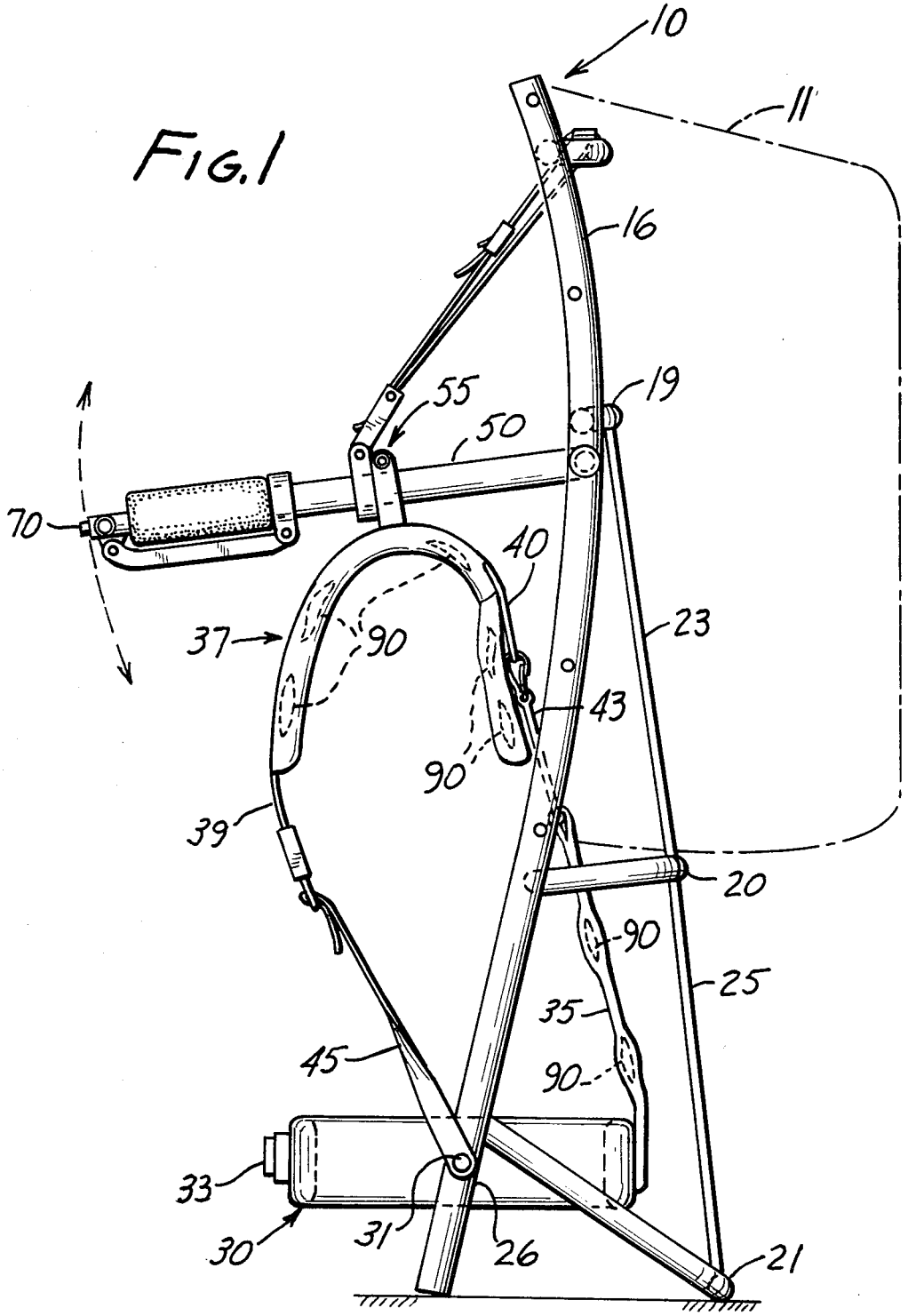
FIG. 1 is a left-hand side elevation of the presently-preferred embodiment of the invention.

Rear risers 35, 36, are attached to the rear of the belt, spaced from one another. Shoulder rests 37, 38 are located above the belt. Shoulder rest 37 has front leg 39 and rear leg 40. Shoulder rest 38 has front leg 41 and rear leg 42. The rear legs are attached to respective rear riser through adjustable-length links. Link 43 is shown in FIG. 1, connecting rear riser 35 to rear leg 40. A similar link (not shown) connects riser 36 and rear leg 42.

Instead of forming the rear risers and the rear legs separately and joining them, they may be made integrally with one another and form a continuous member without interconnection. In such event, the lower portion would be referred to as a rear riser, and the upper portion as the rear leg. Adjustability of the length of the rear portion (riser and leg) is not necessary, even though it is convenient. Adjustability of only the front risers is sufficient.

In addition, the rear risers and the entire shoulder rests can be pocketed to a series of inflatable bladders 90 which can separately be inflated to a desired degree. This inflatability, and in particular the inflatability at selected locations, can significantly improve the comfort and fit over the shoulders and down the back. They are not primarily for load bearing purposes, and usually will not be inflated at the top of the shoulder rests. They are primarily stabilizers relative to lateral motion.

The central portion of the shoulder rests is padded and relatively stiff so that it cannot be pulled along by a load exerted on only one of the legs. It is sufficiently self-shape retaining that such a load will be supported by it, as will be seen.

Front risers 45, 46 are connected to front legs 39 and 41, respectively, and to the lower portions 26, 27, respectively, of the upright rails. Conveniently, they may be attached by bolts 26 and 27. The front risers are flexible, and are length-adjustable by buckles 47, 48.

Thus, there is formed a load-bearing loop from the frame through the belt, up the rear risers and over the shoulder and down the front risers to return to the frame.

Balance rods 50, 51 are mounted to a trunnion rod 52 which is pivotally mounted to upright rails 16 and 17. Rods 50, 51 extend forwardly over respective shoulders of the hiker, and they pivot up and down. If preferred, they could separately be mounted, but mounting to a single trunnion has the merit of better load distribution. Also, only one hand need be used to pull both down, with this arrangement. Rods 50 and 51 are conveniently tubular, with cylindrical outer walls. Hand grips 53, 54 comprising foam sleeves, are fitted over their forward ends for the hiker to grasp.

Connection means 55 connects to shoulder rest 37. A similar connection means (not shown) connects to shoulder rest 38. It is in all ways identical to means 55, so only means 55 will be described in detail. It has a circling clamp 56 which embraces balance rod, and when loosened enables means 55 to be slid along the rod to a desired location. Then the clamp is tightened, and the adjustment is held. The effect is to move the shoulder rests forwardly and rearwardly relative to the frame.

Suspender means 60, 61 are connected between an upper region of the frame, namely cross rail 18, and a respective balance rod. The lower end of each suspender means carries a ring that surrounds the rod, and tends to bear against the respective connection means. Adjustable buckles 62, 63 enable the length of the suspender means to be adjusted. These limit the lowermost angular position of the balance rods. They can, for example, be so shortened as to lift the shoulder rests off of the shoulders.

Forward load-attachment means 70, 71 is mounted to respective balance rods 50, 51. These may be as simple as clips to mount the load directly to the rod, or as sophisticated as the structure now to be described. Both of these, and their equivalents, are comprehended by the term "load attachment means".

It is advantageous not merely to mount a balancing load ahead of the hiker (which not only counterbalances some of the rear load, but also provides additional carrying capacity), but also to adjust its physical moment, by being able to move it forwardly and rearwardly. But in a structure such as a backpack, mechanisms must be lightweight, and preferably should not significantly enlarge the envelope of the structure. The instant invention offers these advantages.

Load attachment means 71 is shown in detail in FIGS. 3–5. Means 70 is identical to it, and will not separately be described.

As best shown in FIG. 3, suspension rod 75 is pivotally joined by a hinge 76 to a headed slider 77. The suspension rod can slide through a bearing 78, but the slider cannot. Thus, rod 75 can be retracted into the balance rod and stored there. Or it can be pulled out so that hinge 76 is outside, and it depends from that hinge. The headed slider holds the suspension rod to the balance rod.

Adjustment means 80 comprises a set collar 81 slidable on rod 75. It has a set screw 82 which will hold the collar in an adjusted position. Swing arm 83 is hinge mounted to balance rod 51. The angular position of rod 75 around hinge 76 can be adjusted by sliding collar 81 along it and fixing it with the set screw. Cross-holes 84 permit attachment of a forward load 85 to the suspension rod, by a clip 86. This construction is duplicated in balance rod 70.

To adjust the backpack, the belt is first fastened around the torso. Then the lengths of the front and rear risers are adjusted so that, with the balance rods in a convenient, usually about horizontal alignment the shoulder rests fit nicely onto the shoulders, and the load will be about equally divided between the torso and the shoulders. Now in use, suppose the hiker prefers to carrying the load entirely on his torso. He need merely shorten the suspender means to lift the balance rods and shoulder rests, and lengthening the front risers. The shoulder rests are now out of action.

Suppose instead that the load is preferred to be carried only on the shoulders. Then the belt would merely be unbuckled. It is a profound advantage for a hiker to be able to change his load bearing conditions from time to time.

The forward load can be moved forwardly and rearwardly by adjusting the angle of the suspension rods relative to the vertical. This gives additional load-bearing capacity, and load-balancing convenience.

Also, moving the connector means forwardly and backwardly can change the moment on the hiker, and changing it from time to time minimizes fatigue. Pulling down on the hand grips can also help importantly, as can swinging the forward load more forwardly or more rearwardly.

Thus, in a device of elegant simplicity the hiker is given great versatility in load bearing locations and load balance. It is particularly useful for persons who have lower back problems.

This invention is not to be limited by the embodiments shown in the drawings and described in the description, which are given by way of example and not of limitation, but only in accordance with the scope of the appended claims.

I claim:

1. A backpack comprising a first and a second generally upright rail and a pair of laterally extending cross-rails joining said upright rails to form a frame adapted to be carried at the back of a person and support a load to be carried, with the upright rails spaced apart, with a lower portion disposed at the side of the person, whereby said lower portions are at opposite sides of the person;

a waist-encircling belt attached to said lower portions, and including a separable buckle to enable the person to be encircled and held by said belt, or to be released from said belt;

a pair of rear risers attached to and rising from spaced apart locations at the rear of said belt;

a pair of shoulder rests each adapted to fit atop a respective shoulder with a front and rear leg, the rear legs being attached to respective rear risers;

a pair of front risers attached to respective said lower portions and to respective front legs, the lengths of at least one riser attached to each shoulder rest being adjustable;

a pair of balance rods pivotally mounted to said frame for up and down pivotal movement forward of said frame;

connection means connecting each of said shoulder rests to a respective balance rod, said connection means being adapted to connect said shoulder rests at a plurality of locations along the respective balance rod;

suspender means interconnecting an upper region of said frame with each of said balance rods, said suspender means being adjustable to determine the lowermost pivotal position of said balance rods; and forward load-attachment means mounted to each of said balance rods forwardly of said frame for supporting a load forwardly of the person, whereby the direct weight of the backpack can be carried exclusively by the belt, by raising the balance rods to lift the shoulder rests from the shoulders, can be carried by both the belt and the shoulder rests by adjusting the forward risers to bring the shoulder rests against the shoulders with the belt fastened, and carried entirely by the shoulder rests by releasing the belt; and whereby the elevation of the shoulder rests can be adjusted by adjusting the length of a riser and a suspender means respective to each balance rod; and whereby a load can be suspended forwardly of the person by said forward load-attachment means.

2. A backpack according to claim 1 in which said suspender means comprise adjustable length straps depending from said frame to said balance rods.

3. A backpack according to claim 1 in which said connection means comprises an encircling clamp slidably mounted to each of said balance rods, and adapted to be tightened onto the respective rod to adjust its position along said balance rod.

4. A backpack according to claim 1 in which a trunnion is pivotally mounted to said frame, and said suspender rods are rigidly attached to said trunnion.

5. A backpack according to claim 1 in which a hand grip is fitted to each of said balance rods.

6. A backpack according to claim 1 in which said load-attachment means comprises a suspension rod pivotally mounted to each of said balance rods, and means for holding said suspension rod in an angularly-adjusted position.

7. A backpack according to claim 6 in which each said suspension rod is slidable into and out of its respective balance rod, and in which a slider fits in said balance rod, and cannot escape therefrom, and in which a hinge joins the slider and the suspension rod, which hinge can be moved to project beyond said balance rod, and can be withdrawn into it, a collar slidable on said suspension rod outside of said balance rod, a swing arm pivotally mounted to said balance rod and carrying said collar, and setscrew means adapted to hold the collar to the suspension rod at a selected location along the length of said suspension rods, and means to hold a load to said suspension rod.

8. A backpack according to claim 3 in which said suspender means comprise adjustable length straps depending from said frame to said balance rods.

9. A backpack according to claim 5 in which said suspender means comprise adjustable length straps depending from said frame to said balance rods.

10. A backpack according to claim 4 in which said suspender means comprise adjustable length straps depending from said frame to said balance rods.

11. A backpack according to claim 6 in which said suspender means comprise adjustable length straps depending from said frame to said balance rods.

12. A backpack according to claim 7 in which said suspender means comprise adjustable length straps depending from said frame to said balance rods.

13. A backpack according to claim 1 in which the rear risers and rear legs are integral.

14. A backpack according to claim 1 in which a plurality of inflatable bladders are provided on the inside of the shoulder rests.

15. A backpack according to claim 1 in which a plurality of inflatable bladders are provided on the side of the rear risers facing the hiker.

16. A backpack according to claim 14 in which said suspender means comprise adjustable length straps depending from said frame to said balance rods.

17. A backpack according to claim 15 in which said suspender means comprise adjustable length straps depending from said frame to said balance rods.

* * * * *